US007833403B2

(12) United States Patent
Xie et al.

(10) Patent No.: US 7,833,403 B2
(45) Date of Patent: Nov. 16, 2010

(54) PLATING, CHEMICAL PLATING TECHNIQUE USING PARTIAL CHEMICAL OXIDATION FOR ALUMINUM OR ALUMINUM COPPER RADIATOR

(75) Inventors: Wenzhen Xie, Guangdong (CN); Donglin Li, Guangdong (CN)

(73) Assignee: TWD Metal Production Co., Ltd., Shuibei Industry Area, Yantian, Femggamg Town, Dongguan, Guangdong (CN)

( * ) Notice: Subject to any disclaimer, the term of this patent is extended or adjusted under 35 U.S.C. 154(b) by 0 days.

(21) Appl. No.: 11/873,327

(22) Filed: Oct. 16, 2007

(65) Prior Publication Data

US 2009/0000952 A1 Jan. 1, 2009

(30) Foreign Application Priority Data

Jun. 29, 2007 (CN) ..... 2007 1 0028893

(51) Int. Cl.

| | |
|---|---|
| ***C23C 28/00*** | (2006.01) |
| ***C25D 11/04*** | (2006.01) |
| ***C25D 5/10*** | (2006.01) |
| ***C25D 5/12*** | (2006.01) |
| ***C25D 5/44*** | (2006.01) |
| ***C25D 5/48*** | (2006.01) |
| ***C25D 5/50*** | (2006.01) |

(52) U.S. Cl. ..... 205/183; 205/172; 205/177; 205/181; 205/213; 205/220; 205/223; 205/224

(58) Field of Classification Search ..... 205/172, 205/177, 181, 213, 220, 223, 224, 183
See application file for complete search history.

(56) References Cited

FOREIGN PATENT DOCUMENTS

JP 11181597 A * 7/1999

* cited by examiner

*Primary Examiner*—Edna Wong
(74) *Attorney, Agent, or Firm*—Global IP Serivices; Tianhua Gu

(57) ABSTRACT

This invention involves the technological field of electroplating, chemical plating, specially involves a method for partially plating aluminum and aluminum copper radiators. A radiator is conducted partial chemical oxidation and enclosure before undergoing galvanization. Firstly oxidize the non-plate surface of the radiator by chemical oxidation, then utilize a sealing compound to fill up tiny holes of the porous layer to make a film thereon against the erosion of acid and alkali, and then process common chemical plating or electroplating. Only plate a weldable nickel-phosphorus alloy on the touching parts at where the aluminum radiator or the aluminums and copper radiator connect with the main frame.

5 Claims, 2 Drawing Sheets

PLATING, CHEMICAL PLATING TECHNIQUE USING PARTIAL CHEMICAL OXIDATION FOR ALUMINUM OR ALUMINUM COPPER RADIATOR

CROSS REFERENCE TO THE RELATED PATENT APPLICATION

This application claims the priority of the Chinese patent application No. 200710028893.0 with filing date of Jun. 29, 2007.

FIELD OF THE INVENTION

This invention involves the electroplating or chemical plating technique for aluminum and aluminum copper radiators. Specifically, involves the electroplating or chemical plating technique for an aluminum and aluminum copper radiator.

BACKGROUND OF THE INVENTION

An aluminum radiator is formed by stacking of many aluminum sheets. An aluminum copper radiator is formed by copper heat pipes tightly plugging in the aluminum radiator. Since the weldability of aluminum is poor, it is necessary to plate a layer of weldable alloy of nickel-phosphorus on the location where the aluminum or aluminum copper radiator connects with the main frame, so that the above-mentioned aluminum radiator or aluminum copper radiator can connect with the main frame by weld.

On the aluminum surface, it is easy to form a natural film, which is not good for the electroplating or chemical plating. For the electroplating or chemical plating on the aluminum surface, which must have preplating for the latter plating. The current regular preplating is a double galvanization technique. See the attached FIG. 1 of the current ordinary chemical plating of nickel-phosphorus alloy. The procedures are described as follows:

Step 1: degreasing, removing the oil stain on the radiator surface.

Step 2: water rinsing, cleaning the radiator.

Step 3: weak erosion, putting the radiator in the lye and conducting weak erosion on the radiator surface.

Step 4: water rinsing, cleaning the radiator.

Step 5: acid liquor washing for surface brightness, putting the radiator in the acid liquor until its surface appears bright.

Step 6: water rinsing, cleaning the radiator;

Step 7: first galvanization, putting the radiator in the lye containing zincates for the first galvanization.

Step 8: water rinsing, cleaning the radiator

Step 9: removing the zinc, putting the radiator in acid liquor for zinc removal.

Step 10: water rinsing, cleaning the radiator;

Step 11: second galvanization, putting the radiator in a lye containing zincates for the second galvanization;

Step 12: Water rinsing, cleaning the radiator;

Step 13: chemical plating nickel and phosphor alloy, putting the radiator in a chemical plating trough of nickel, chemical plating the nickel and phosphor on the radiator surface.

Step 14: Water rinsing, cleaning the radiator;

Step 15: drying the radiator

Step 16: parching the radiator

Step 17: finished products

The above process flow can be simplified as: preplating 1, galvanization 2, chemical plating nickel-phosphorus alloy and post-treatment 3, and finished products 4.

After the radiator is chemical plated with nickel-phosphorus alloy, the whole aluminum or aluminum copper radiator is plated with nickel-phosphorus alloy, including the welding section and the non-welding section of the radiator; the non-welding section of the radiator does not need plating. The costs for nickel and phosphor alloy are expensive, which causes the price of aluminum or aluminum copper radiators stay high as always.

SUMMARY OF THE INVENTION

The purpose of this invention aims to provide a kind of electroplating or chemical plating technique with partial chemical oxidation to the aluminum and aluminum copper radiator to overcome the deficiency of present common techniques. This technique only applies chemical plating or electroplating to a section of the radiator that needs plating, which is simple and easy for implementation, saving nickel and effectively reducing the product costs.

To achieve the aforesaid goal, this kind of electroplating or chemical plating technique with a partial chemical oxidation of the aluminum and aluminum and copper radiator includes the following procedures:

Step 1: pretreatment to a radiator, applying degreasing, water rinsing, weak erosion (conducting the weak erosion with lye, water rinsing, acid liquor washing for surface brightness), water rinsing.

Step 2: partial chemical oxidation. During partial chemical oxidization, put a section of the aluminum and aluminum copper radiator that is needless for plating into an oxidization trough containing solutions with oxidant. A section needing plating is above the trough surface to avoid oxidization. After partial chemical oxidation, the surface of the section that is needless for plating of the aluminum or aluminum copper radiator is covered with a colorless porous film.

Step 3: water rinsing.

Step 4: enclosure (filled up), putting the whole radiator in an enclosed trench with water solution containing sealing compound; after enclosure, the holes of the porous film on the radiator surface is filled up with sealing compound; thus on the radiator surface there is a film against erosion of acid and alkali.

Step 5: water rinsing.

Step 6: weak erosion; putting the whole radiator in lye to conduct partial weak erosion for the section that need plating of the radiator.

Step 7: water rinsing.

Step 8: acid liquor washing for surface brightness.

Step 9: water rinsing

Step 10: galvanization, conducting galvanization, water rinsing, zinc removal (acid cleaning), second galvanization, water rinsing to the radiator one step by one step.

Step 11: plate nickel-phosphorus alloy, conducting chemical plating or electroplating for the radiator, the section not covered by the porous film is plated with nickel-phosphorus alloy.

Step 12: post-treatment, then conducting water rinsing, drying and parching to the radiator.

Step 13: finished product.

As shown in the above-mentioned technical plan, the inventor developed a partial plating technique to save some precious metals such as nickel. This invention is to conduct partial chemical oxidization and enclosure before the galvanization process of the radiators. First, the non-plating section is oxidized through oxidization and covered with a layer of porous film. Then the holes in the porous film are filled up with sealing compound through enclosure process, which forms a film against the acid and alkali. Then the following process is a common chemical plating or electroplating. In the subsequent processes, the film against acid and alkali will not be accumulated the zinc, thereby will not be plated with nickel-phosphorus alloy. The weldable nickel-phosphorus alloy is only plated in the section where the aluminum or aluminum copper radiator is connected with the mainframe. This technique applies plating to the section of the aluminum or aluminum copper radiators needing plating, thus called partial plating. The core technology in the partial chemical oxidization and enclosure of the invention can also be applied to copper (electro) plating, nickel-plating layer or chemical copper plating, which is the corresponding processes of electro-coppering, electro-nickel plating or chemical copper plating after second galvanization. Therefore, the partial electro-coppering, electro-nickel plating or chemical copper plating on the aluminum or aluminum copper radiators can be achieved. It saves many expensive metals and reduces the costs. In summary, this invention applies the partial chemical plating or electroplating to the sections needing plating in the radiators. The process is simple and easy to be carried out. It can save expensive metals such as nickel and reduce manufacture costs.

BRIEF DESCRIPTION OF THE DRAWINGS

Attached

Attached

DETAIL DESCRIPTION OF THE INVENTION

Figure 1:
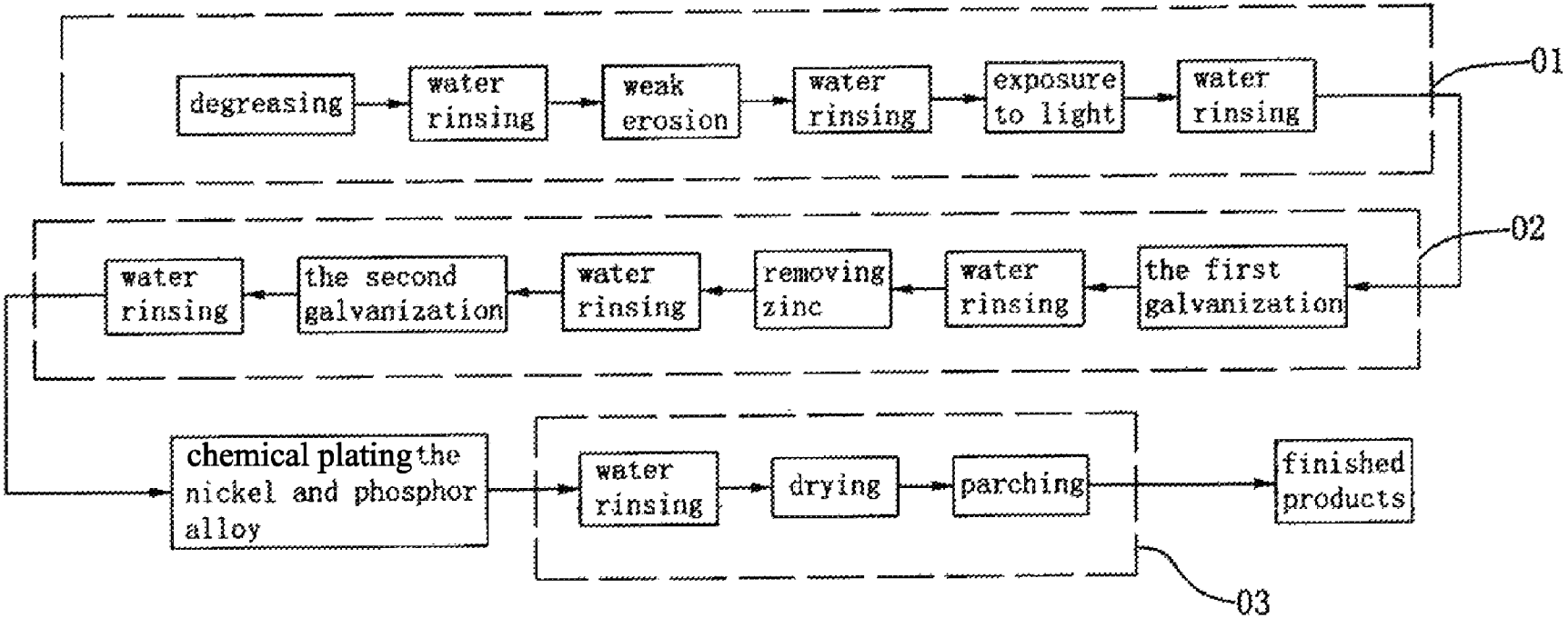
FIG 1 Prior Art
FIG. 1: technical process flow of the current nickel-electrodepositing of radiators.
Figure 2:
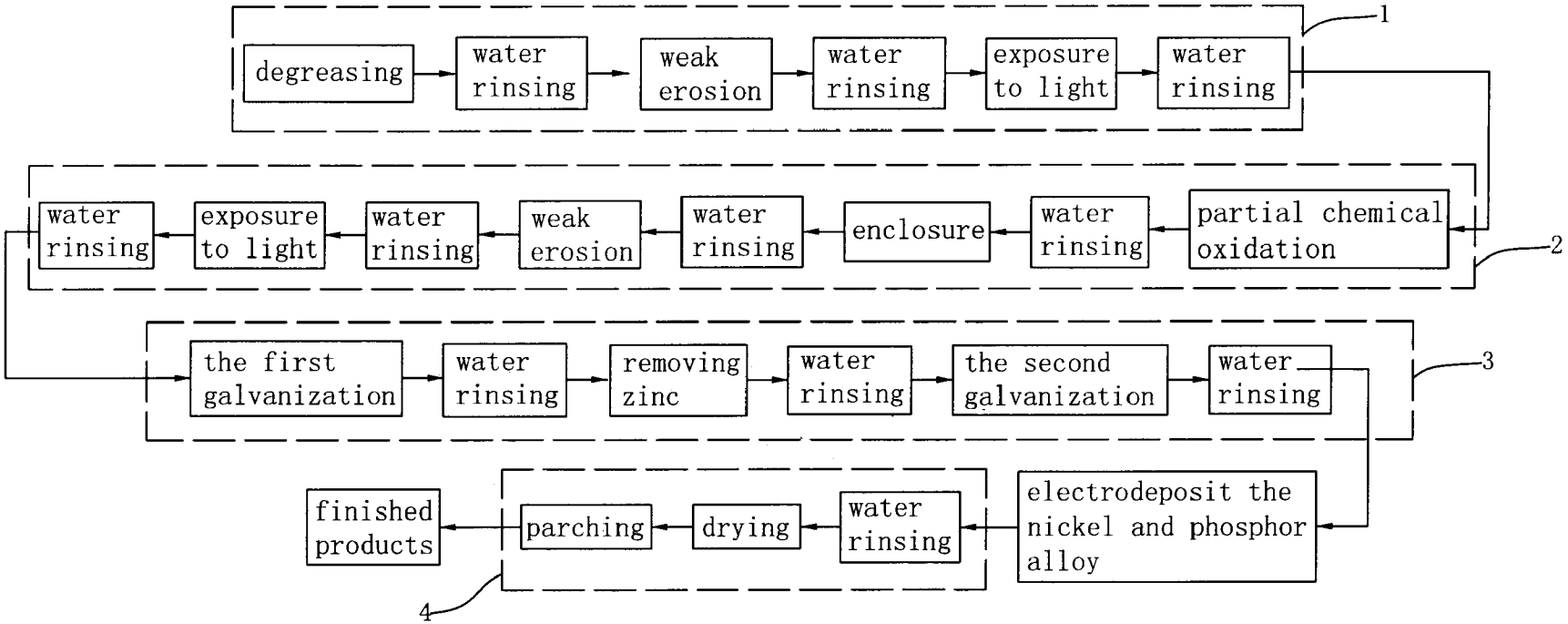
FIG. 2: technical process flow of this invention.

To further disclose this invention, the following will give the illustration together with attached FIG. 2, including the following procedures:

Step 1: conducting a pretreatment to a radiator, applying degreasing, water rinsing, weak erosion (with lye), water rinsing, acid liquor washing for surface brightness, water rinsing; each procedure for the pretreatment in this invention is the same as the common process technique in the pretreatment.

Step 2: partial chemical oxidation. During partial chemical oxidization, put the section that need not plating of the aluminum and aluminum copper radiator into an oxidization trough containing solutions with oxidant. The section needing plating is above the trough surface to avoid oxidization. The mentioned oxidants are organic amine, which are trolamine or formamine. After the partial chemical oxidization, the aluminum or aluminum copper radiators' surface that is under the trough surface is covered with a layer of colorless porous film.

The solution temperature is 80-95° C.; the time for oxidization is 8-30 min. the thickness of the porous film after oxidization is 0.5-5 micron.

Step 3: water rinsing, cleaning the radiator

Step 4: enclosure (filled up), putting the radiator in the enclosed trough with water solution containing sealing compound; the mentioned sealing compound is boric acid; after the enclosure of radiator is completed, the holes of porous film on the radiator surface is filled up with the sealing compound. A film is formed on the radiator surface that is against the erosion of acid and alkali. Here, the temperature of water solution containing sealing compound is around 85-95° C. and the enclosure time is 8-30 min.

The porous film formed on the radiator surface in Step 2 cannot withstand the erosion of acid and alkali, so the base of aluminum or aluminum copper radiator will be settled with a layer of zinc due to the erosion of alkali in the zincates. Thus, the section covered with the porous film still can be plated with nickel and phosphor alloy in the trough of chemical plating. Therefore, the holes in this porous film should be filled up with sealing compound to make it against acid and alkali; this procedure is called enclosure.

Step 5: water rinsing, cleaning the radiator.

Step 6: weak erosion, putting the radiator in the lye and applying weak erosion to the section that need plate, this technique is the same as the common technique of weak erosion.

Step 7: water rinsing, cleaning the radiator.

Step 8: acid liquor washing for surface brightness, this technique is the same as the common technique.

Step 9: water rinsing, cleaning the radiator.

Step 10: twice galvanizations, conducting the first galvanization, water rinsing, zinc removal (washed with acid), water rinsing, the second galvanization, water rinsing one step by one step. Each technique in this procedure is the same as the common technique.

Step 11: plate with nickel-phosphorus alloy, conducting chemical plating or electroplating to the radiator, this technique is the same as the common nickel-electrodepositing technique. Only the section of the radiator not covered by the film that is against the erosion of acid and alkali is plated with nickel and phosphor alloy, partial plating being carried out.

Step 12: post-treatment, conducting water rinsing, drying, parching to the radiator; the technique in this step is the same as the common technique.

Step 13: finished products.

In the techniques of this invention, the weldable nickel and phosphor alloy is only plated on the section at where the aluminum radiator or aluminum copper radiator is connected with the mainframe; the other sections are not plated with nickel and phosphor alloy. The aluminum radiator or aluminum copper radiator is only partially plated. The technique is simple and can save the nickel and phosphor alloys.

This invention is based on the current technique. Before the galvanization is applied, the radiator is partially oxidized. The procedures can be simplified as: preplating 1, partial chemical oxidization 2, galvanization 3, plating of nickel-phosphorus alloy and post plating 4, finished products.

The core procedures of partial chemical oxidization and enclosure can also be applied to electro-coppering, nickel electrodepositing or chemical copper plating. That is, continuing with the corresponding electro-coppering, nickel electrodepositing or chemical copper electrodepositing after the second galvanization in order to the partial electro-coppering, nickel electrodepositing or chemical copper electrodepositing to the aluminum radiator or aluminum copper radiators. It can save all kinds of expensive metals and reduce the product costs.

The description above is a better implementation example of the invention. Therefore, all the equivalent changes or embellishment according to the structure, characteristics stated in the patent scope of the invention are included in the patent applicable scope of this invention.

What is claimed is:

1. An electroplating, chemical plating method using partial chemical oxidation for an aluminum or aluminum copper radiator comprising the following steps:

Step 1: pretreatment to the radiator:

applying degreasing, water rinsing, weak erosion by lye, water rinsing, acid liquor washing for surface brightness, and water rinsing;

Step 2: partial chemical oxidation to the radiator: immersing a part of the radiator for no plating into an oxidization trough containing a solution with an oxidant, a part of the radiator for plating is above the solution surface to avoid oxidization, after the part of the radiator for no plating is oxidized, a surface thereof is covered with a colorless porous film;

Step 3: water rinsing;

Step 4: enclosure: immersing the radiator in an enclosed trench with a water solution containing a sealing compound, after the radiator is enclosed, tiny holes of the porous film on the part of the radiator for no plating are filled up with the sealing compound to form a film against erosion of acid or alkali on the radiator surface;

Step 5: water rinsing;

Step 6: weak erosion, putting whole of the radiator in lye and conducting weak erosion to the part of the radiator for plating;

Step 7: water rinsing;

Step 8: acid liquor washing for surface brightness;

Step 9: water rinsing;

Step 10: twice galvanizations:

conducting galvanization, water rinsing, zinc removal by acid cleaning, second galvanization, and water rinsing;

Step 11: plating nickel-phosphorus alloy: conducting chemical plating or electroplating for the radiator, only a part not covered by the film against erosion is plated with nickel-phosphorus alloy, thereby the part of the radiator for plating is plated with the nickel-phosphorus alloy;

Step 12: post-treatment, then conducting water rinsing, drying and parching to the radiator; and Step 13: finished product.

2. The method of claim 1, wherein for the partial chemical oxidization in Step 2, the oxidant is an organic amine selected from trolamine or formamine.

3. The method of claim 1, wherein for the partial chemical oxidization in Step 2, the solution temperature is 80-95° C. the time for the oxidization is 8-30 min, and the thickness of the porous film after the oxidization is 0.5-5 micron.

4. The method of claim 1, wherein for the enclosure in Step 4, the sealing compound is boric acid.

5. The method of claim 1, wherein for the enclosure in Step 4, the temperature of the water solution containing the sealing compound is 85-95° C. and the enclosure time is 8-30 min.

* * * * *